US009047853B2

(12) United States Patent
Dejima

(10) Patent No.: US 9,047,853 B2
(45) Date of Patent: Jun. 2, 2015

(54) ELECTRONIC STRINGED INSTRUMENT, MUSICAL SOUND GENERATION METHOD AND STORAGE MEDIUM

(71) Applicant: CASIO COMPUTER CO., LTD., Shibuya-ku, Tokyo (JP)

(72) Inventor: Tatsuya Dejima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/161,075

(22) Filed: Jan. 22, 2014

(65) Prior Publication Data

US 2014/0202317 A1 Jul. 24, 2014

(30) Foreign Application Priority Data

Jan. 24, 2013 (JP) ..... 2013-011409

(51) Int. Cl.
*G10H 1/18* (2006.01)
*G10H 1/34* (2006.01)
*G10H 3/12* (2006.01)

(52) U.S. Cl.
CPC . *G10H 1/18* (2013.01); *G10H 1/34* (2013.01); *G10H 1/342* (2013.01); *G10H 3/125* (2013.01)

(58) Field of Classification Search
USPC ..... 84/615, 653
IPC ..... G10H 1/18,1/06
See application file for complete search history.

(56) References Cited

U.S. PATENT DOCUMENTS 4,951,545 A * 8/1990 Yoshida ..... 84/646
5,018,428 A 5/1991 Uchiyama et al.
5,085,119 A * 2/1992 Cole ..... 84/724
5,286,911 A * 2/1994 Murata et al. ..... 84/615
5,398,585 A * 3/1995 Starr ..... 84/646
5,557,057 A * 9/1996 Starr ..... 84/617
6,995,311 B2 * 2/2006 Stevenson ..... 84/737
8,395,040 B1 * 3/2013 Kramer et al. ..... 84/733
8,614,389 B2 * 12/2013 Wallace et al. ..... 84/733
8,841,537 B2 * 9/2014 Sullivan ..... 84/724
2004/0187673 A1 * 9/2004 Stevenson ..... 84/737
2006/0243123 A1 * 11/2006 Ierymenko ..... 84/742
2008/0236374 A1 * 10/2008 Kramer et al. ..... 84/733
2009/0260508 A1 * 10/2009 Elion ..... 84/646
2011/0011248 A1 * 1/2011 Elion ..... 84/646
2011/0308378 A1 * 12/2011 Wallace et al. ..... 84/689
2013/0068087 A1 * 3/2013 Wallace et al. ..... 84/733
2013/0074680 A1 * 3/2013 Elion ..... 84/646
2013/0180384 A1 * 7/2013 Van Wagoner et al. ..... 84/485 R
2014/0060290 A1 * 3/2014 Wallace et al. ..... 84/733
2014/0190336 A1 * 7/2014 Dejima ..... 84/622
2014/0190337 A1 * 7/2014 Nakae et al. ..... 84/735
2014/0190338 A1 * 7/2014 Dejima et al. ..... 84/735
2014/0202317 A1 * 7/2014 Dejima ..... 84/646
2014/0290467 A1 * 10/2014 Thee et al. ..... 84/646

FOREIGN PATENT DOCUMENTS

JP 63-136088 A 6/1988

* cited by examiner

*Primary Examiner* — David Warren
(74) *Attorney, Agent, or Firm* — Holtz, Holtz, Goodman & Chick PC

(57) ABSTRACT

A CPU 41 detects an operation performed with respect to a plurality of frets 23 provided on a fingerboard 21, decides pitch of a musical sound to be generated based on the detected operation, decides sound generation timing for the musical sound to be generated, instructs a sound source to generate a musical sound of the decided pitch at the decided sound generation timing, and controls the musical sound generated in the sound source 45 based on a state of the detected operation.

19 Claims, 17 Drawing Sheets

ELECTRONIC STRINGED INSTRUMENT, MUSICAL SOUND GENERATION METHOD AND STORAGE MEDIUM

This application is based upon and claims the benefit of priority from the prior Japanese Patent Application No. 2013-11409, filed Jan. 24, 2013, and the entire contents of which are incorporated herein by reference.

BACKGROUND OF THE INVENTION

1. Field of the Invention

The present invention relates to an electronic stringed instrument, a musical sound generation method and a storage medium.

2. Related Art

An input control device is conventionally known for extracting pitch of an input waveform signal to instruct to generate a musical sound corresponding to the extracted pitch. As this type of a device, the technique has been disclosed in, for example, Japanese Unexamined Patent Application Publication No. S63-136088 for detecting a waveform zero-cross period immediately after detection of a maximum value of an input waveform signal and a waveform zero-cross period immediately after detection of a minimum value of the input waveform signal, and when both periods are approximately coincident with each other, instructing to generate a musical sound of pitch corresponding to the detected period, or detecting a maximum value detection period and a minimum value detection period of the input waveform signal, and when both periods are approximately coincident with each other, instructing to generate a musical sound of pitch corresponding to the detected period.

However, even using a method of this type, the strength of string-pressing with the left hand is not detected. Such a string-pressing force with the left hand varies in many stages in an actual guitar.

For example, a string is vibrated with correct musical pitch in the case of pressing a string to the extent of light press of a fret rather than fully pressing of the string down to a fingerboard. In a case where such a string-pressing force is increased, the string largely sinks down to the fingerboard together with a finger, thereby increasing tension of the string, resulting in a slight increase of the musical pitch. Using such a mechanism, a performer plays with vibrato.

Moreover, in a case where the string is in turn brought close to the fret with a press force of the finger to the extent that they are nearly pressing each other (actually not pressed), a phenomenon is then repeated that the string temporarily presses and moves away from the fret by string vibration. Thereby, both states occur where musical pitch is produced and where sound is completely muted with the finger. Such a sound sounds like a sound generated by mixing one half each of normal string vibration and a muted sound.

The string-pressing force further decreased from this state, and as the string moves completely away from the fret even though the finger is pressing the string, the volume of a normal sound of the string gets smaller, and contrarily, the muted sound gets greater.

Although the performer controls the strength of string-pressing with the left hand to subtly control timbre, a state of string-pressing with the left hand was not detected by a conventional method. Thus, there was no structure to generate the sound in this way, and subtle changes in timbre and pitch could not be reflected in accordance with the state of string-pressing.

SUMMARY OF THE INVENTION

The present invention has been realized in consideration of this type of situation, and it is an object of the present invention to provide an electronic stringed instrument capable of reflecting subtle changes in timbre and pitch according to a state of string-pressing.

In order to achieve the above-mentioned object, an electronic stringed instrument according to an aspect of the present invention includes:

an operation detection unit configured to detect an operation performed with respect to a plurality of frets provided on a fingerboard;

a pitch decision unit configured to decide pitch of a musical sound to be generated based on the operation detected by the operation detection unit;

a sound generation timing decision unit configured to decide sound generation timing for the musical sound to be generated;

a sound generation instruction unit configured to instruct a sound source to generate a musical sound of the pitch decided by the pitch decision unit at the sound generation timing decided by the sound generation timing decision unit; and a control unit configured to control the musical sound generated in the sound source based on a state of the operation detected by the operation detection unit.

DETAILED DESCRIPTION OF THE INVENTION

Descriptions of embodiments of the present invention are given below, using the drawings.

Overview of Electronic Stringed Instrument 1

Figure 1:
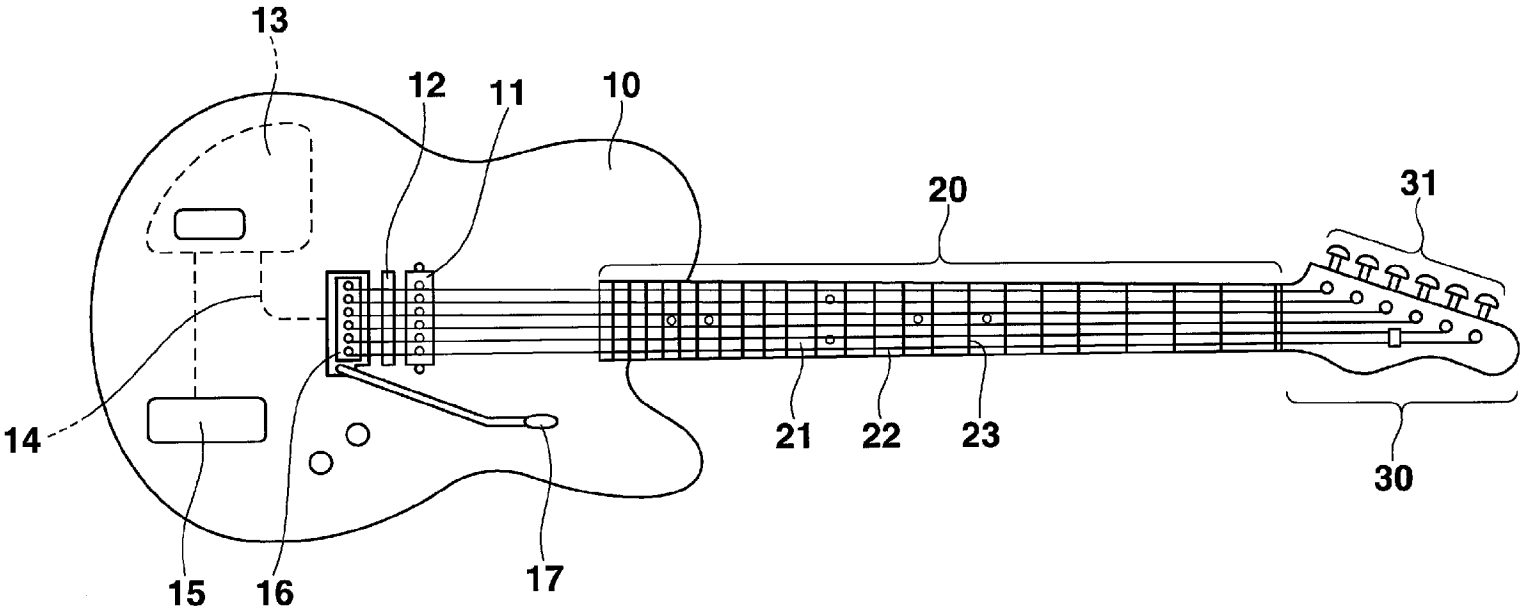
FIG. 1 is a front view showing an appearance of an electronic stringed instrument of the present invention.

First, a description for an overview of an electronic stringed instrument 1 as an embodiment of the present invention is given with reference to FIG. 1.

FIG. 1 is a front view showing an appearance of the electronic stringed instrument 1. As shown in FIG. 1, the electronic stringed instrument 1 is divided roughly into a body 10, a neck 20 and a head 30.

The head 30 has a threaded screw 31 mounted thereon for winding one end of a steel string 22, and the neck 20 has a fingerboard 21 with a plurality of frets 23 embedded therein. It is to be noted that in the present embodiment, provided are 6 pieces of the strings 22 and 23 pieces of the frets 23. 6 pieces of the strings 22 are associated with string numbers, respectively. The thinnest string 22 is numbered "1". The string number becomes higher in order that the string 22 becomes thicker. 22 pieces of the frets 23 are associated with fret numbers, respectively. The fret 23 closest to the head 30 is numbered "1" as the fret number. The fret number of the arranged fret 23 becomes higher as getting farther from the head 30 side.

The body 10 is provided with: a bridge 16 having the other end of the string 22 attached thereto; a normal pickup 11 that detects vibration of the string 22; a hex pickup 12 that independently detects vibration of each of the strings 22; a tremolo arm 17 for adding a tremolo effect to sound to be emitted; electronics 13 built into the body 10; a cable 14 that connects each of the strings 22 to the electronics 13; and a display unit 15 for displaying the type of timbre and the like.

Figure 2:
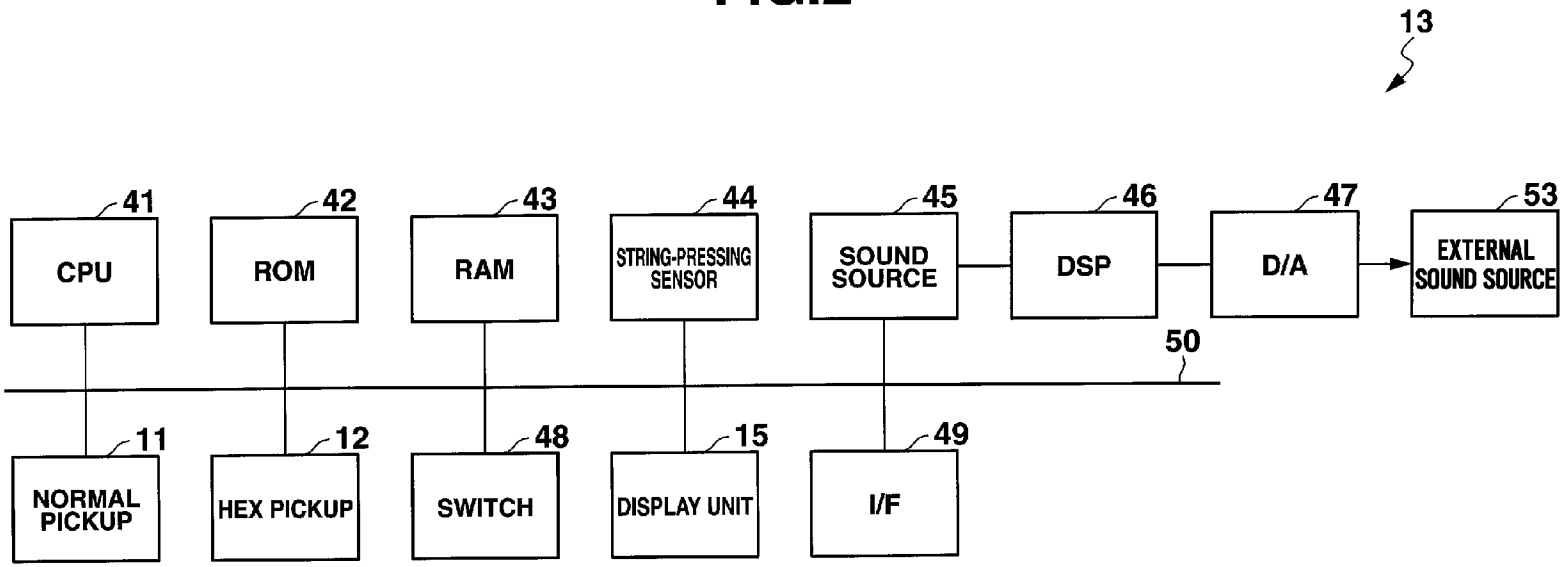
FIG. 2 is a block diagram showing an electronics hardware configuration constituting the above-described electronic stringed instrument.

FIG. 2 is a block diagram showing an electronics hardware configuration of the electronics 13. The electronics 13 have a CPU (Central Processing Unit) 41, a ROM (Read Only Memory) 42, a RAM (Random Access Memory) 43, a string-pressing sensor 44, a sound source 45, the normal pickup 11, a hex pickup 12, a switch 48, the display unit 15 and an I/F (interface) 49, which are connected via a bus 50 to one another.

Additionally, the electronics 13 include a DSP (Digital Signal Processor) 46 and a D/A (digital/analog converter) 47.

The CPU 41 executes various processing according to a program recorded in the ROM 42 or a program loaded into the RAM 43 from a storage unit (not shown in the drawing).

In the RAM 43, data and the like required for executing various processing by the CPU 41 are appropriately stored.

The string-pressing sensor 44 detects which number of the fret is pressed by which number of the string. The string-pressing sensor 44 detects whether a string-pressing operation is performed with respect to the string 22 (refer to FIG. 1) on any of the frets 23 (refer to FIG. 1) based on output from an electrostatic sensor described below.

The sound source 45 generates waveform data of a musical sound instructed to be generated, for example, through MIDI (Musical Instrument Digital Interface) data, and outputs an audio signal obtained by D/A converting the waveform data to an external sound source 53 via the DSP 46 and the D/A 47, thereby giving an instruction to generate and mute the sound. It is to be noted that the external sound source 53 includes an amplifier circuit (not shown in the drawing) for amplifying the audio signal output from the D/A 47 for outputting, and a speaker (not shown in the drawing) for emitting a musical sound by the audio signal input from the amplifier circuit.

The normal pickup 11 converts the detected vibration of the string 22 (refer to FIG. 1) to an electric signal, and outputs the electric signal to the CPU 41.

The hex pickup 12 converts the detected independent vibration of each of the strings 22 (refer to FIG. 1) to an electric signal, and outputs the electric signal to the CPU 41.

The switch 48 outputs to the CPU 41 an input signal from various switches (not shown in the drawing) mounted on the body 10 (refer to FIG. 1).

The display unit 15 displays the type of timbre and the like to be generated.

Figure 3:
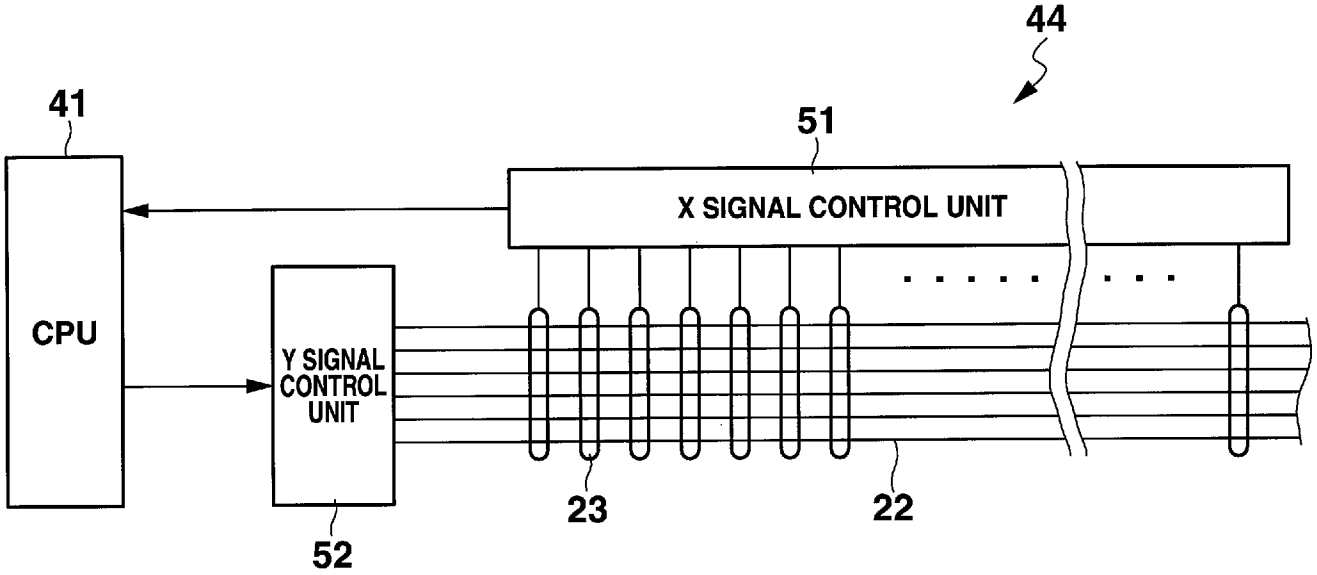
FIG. 3 is a schematic diagram showing a signal control unit of a string-pressing sensor.

FIG. 3 is a schematic diagram showing a signal control unit of the string-pressing sensor 44.

In the string-pressing sensor 44, a Y signal control unit 52 sequentially specifies any of the strings 22 to specify an electrostatic sensor corresponding to the specified string. An X signal control unit 51 specifies any of the frets 23 to specify an electrostatic sensor corresponding to the specified fret. In this way, only the simultaneously specified electrostatic sensor of both the string 22 and the fret 23 is operated to output a change in an output value of the operated electrostatic sensor to the CPU 41 (refer to FIG. 2) as string-pressing position information.

Figure 4:
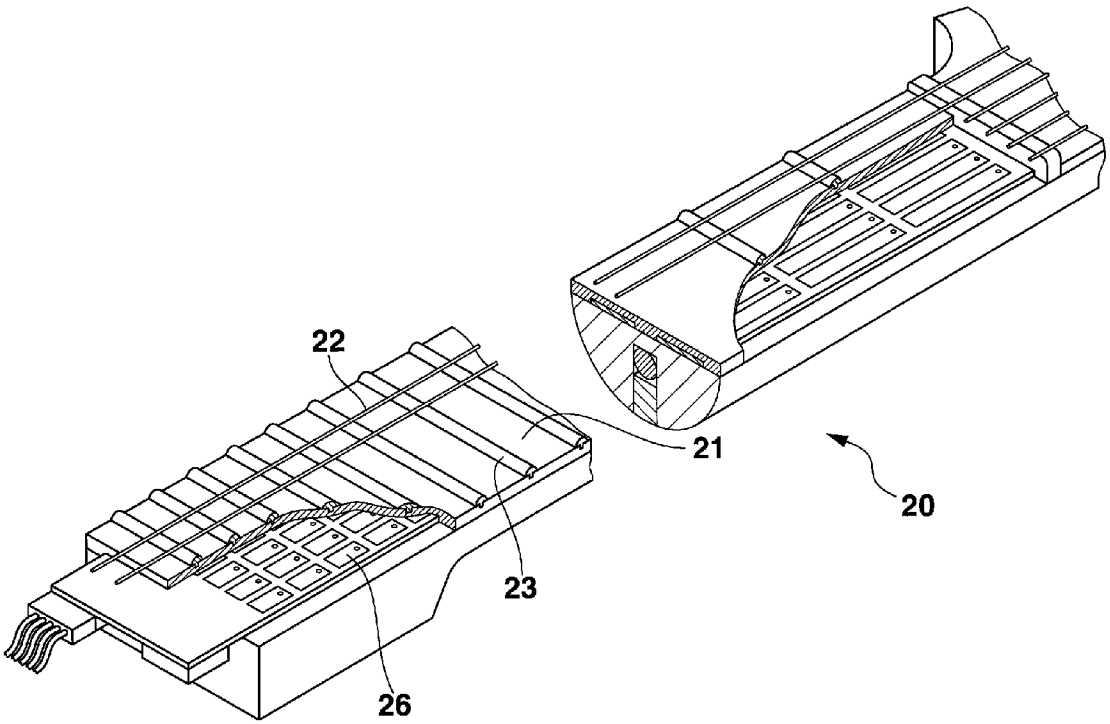
FIG. 4 is a perspective view of a neck applied with the type of a the string-pressing sensor for detecting string-pressing without detecting contact of the string with the fret based on output from an electrostatic sensor.

FIG. 4 is a perspective view of the neck 20 applied with the type of the string-pressing sensor 44 for detecting string-pressing without detecting contact of the string 22 with the fret 23 based on output from an electrostatic sensor.

In FIG. 4, an electrostatic pad 26 as an electrostatic sensor is arranged under the fingerboard 21 in association with each of the strings 22 and each of the frets 23. That is, in the case of 6 strings ×22 frets like the present embodiment, electrostatic pads are arranged in 144 positions. These electrostatic pads 26 detect electrostatic capacity when the string 22 approaches the fingerboard 21, and sends the electrostatic capacity to the CPU 41. The CPU 41 detects the string 22 and the fret 23 corresponding to a string-pressing position based on the sent value of the electrostatic capacity.

Main Flow

Figure 5:
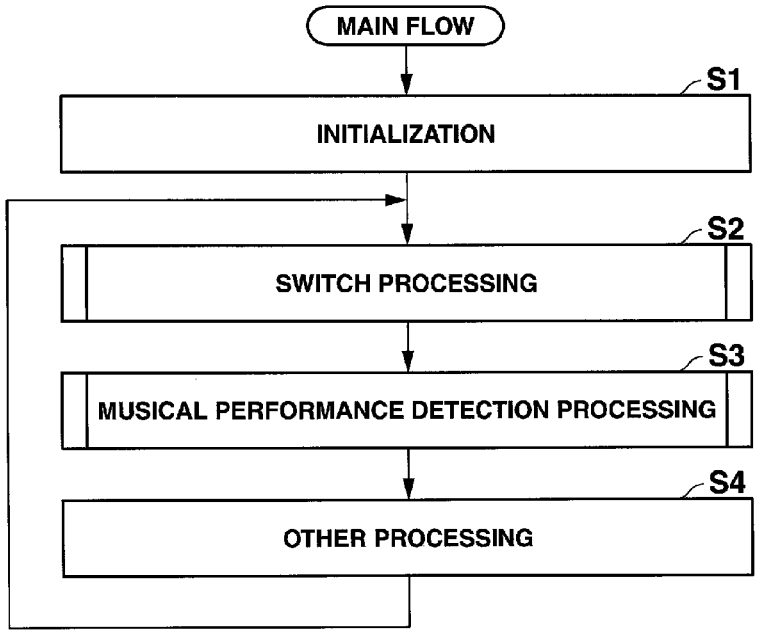
FIG. 5 is a flowchart showing a main flow executed in the electronic stringed instrument according to the present embodiment.

FIG. 5 is a flowchart showing a main flow executed in the electronic stringed instrument 1 according to the present embodiment.

Initially, in step S1, the CPU 41 is powered to be initialized. In step S2, the CPU 41 executes switch processing (described below in FIG. 6). In step S3, the CPU 41 executes musical performance detection processing (described below in FIG. 8). In step S4, the CPU 41 executes other processing. In the other processing, the CPU 41 executes, for example, processing for displaying a name of an output chord on the display unit 15. After the processing of step S4 is finished, the CPU 41 advances processing to step S2 to repeat the processing of steps S2 up to S4.

Switch Processing

Figure 6:
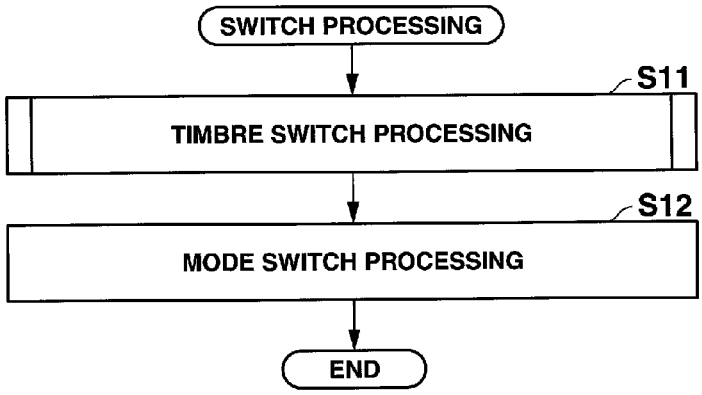
FIG. 6 is a flowchart showing switch processing executed in the electronic stringed instrument according to the present embodiment.

FIG. 6 is a flowchart showing switch processing executed in the electronic stringed instrument 1 according to the present embodiment.

Initially, in step S11, the CPU 41 executes timbre switch processing (described below in FIG. 7). In step S12, the CPU 41 executes mode switch processing. In the mode switch processing, the CPU 41 decides a mode for identifying whether any of three types of parameter change processing described below (FIG. 17, FIG. 19 and FIG. 21) is executed. After the processing of step S12 is finished, the CPU 41 finishes the switch processing.

Timbre Switch Processing

Figure 7:
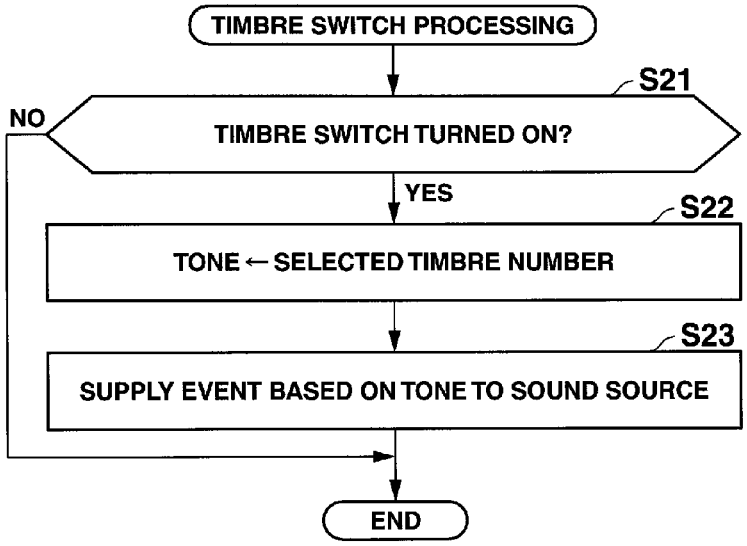
FIG. 7 is a flowchart showing timbre switch processing executed in the electronic stringed instrument according to the present embodiment.

FIG. 7 is a flowchart showing timbre switch processing executed in the electronic stringed instrument 1 according to the present embodiment.

Initially, in step S21, the CPU 41 determines whether or not a timbre switch (not shown in the drawing) is turned on. When it is determined that the timbre switch is turned on, the CPU 41 advances processing to step S22, and when it is determined that the switch is not turned on, the CPU 41 finishes the timbre switch processing. In step S22, the CPU 41 stores in a variable TONE a timbre number corresponding to timbre specified by the timbre switch. In step S23, the CPU 41 supplies an event based on the variable TONE to the sound source 45. Thereby, timbre to be generated is specified in the sound source 45. After the processing of step S23 is finished, the CPU 41 finishes the timbre switch processing.

Musical Performance Detection Processing

Figure 8:
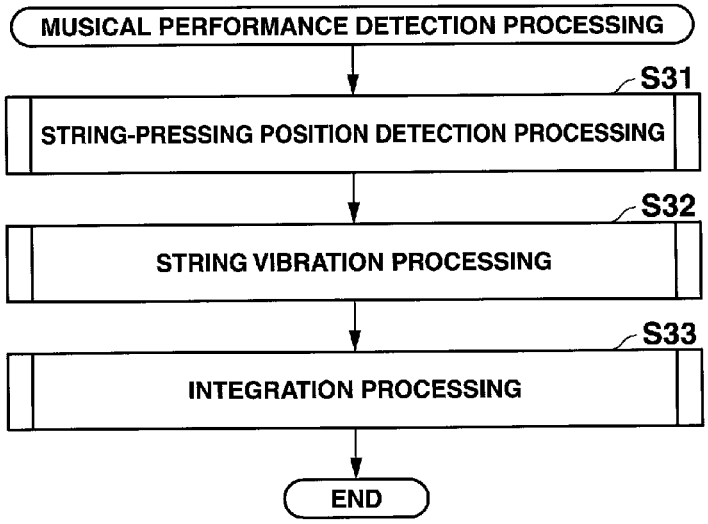
FIG. 8 is a flowchart showing musical performance detection processing executed in the electronic stringed instrument according to the present embodiment.

FIG. 8 is a flowchart showing musical performance detection processing executed in the electronic stringed instrument 1 according to the present embodiment.

Initially, in step S31, the CPU 41 executes string-pressing position detection processing (described below in FIG. 9). In step S32, the CPU 41 executes string vibration processing (described below in FIG. 12). In step S33, the CPU 41 executes integration processing (described below in FIG. 16). After the processing of step S33 is finished, the CPU 41 finishes the musical performance detection processing.

String-pressing position Detection Processing

Figure 9:
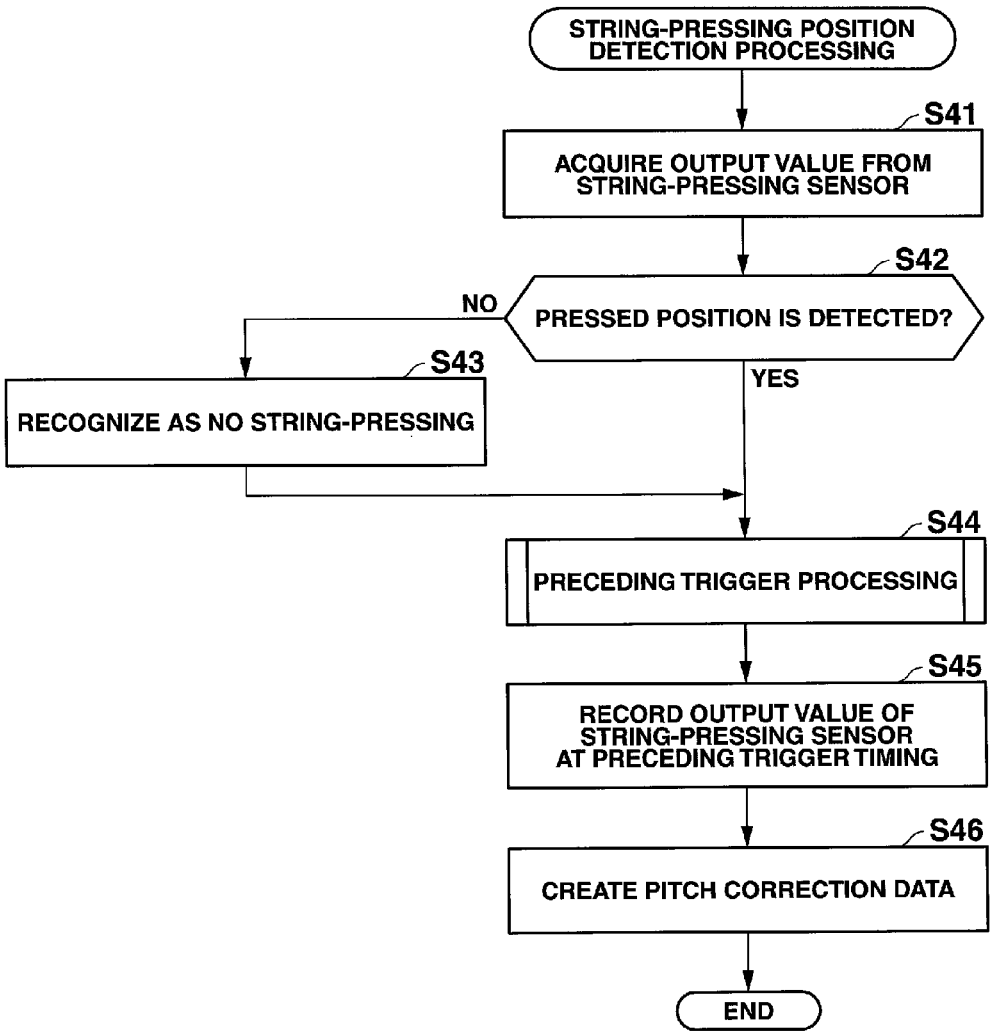
FIG. 9 is a flowchart showing string-pressing position detection processing executed in the electronic stringed instrument according to the present embodiment.

FIG. 9 is a flowchart showing string-pressing position detection processing (processing of step S31 in FIG. 8) executed in the electronic stringed instrument 1 according to the present embodiment.

Initially, in step S41, the CPU 41 acquires an output value from the string-pressing sensor 44. Specifically, the CPU 41 receives, as an output value of the string-pressing sensor 44, the value of electrostatic capacity corresponding to a string number and a fret number. In step S42, the CPU 41 determines whether or not a pressed position is detected. Determination that a pressed position is detected is made as follows. The CPU 41 determines, in a case where the received value of electrostatic capacity corresponding to a string number and a fret number exceeds a predetermined threshold, that string-pressing is performed in an area corresponding to the string number and the fret number, that is, in a pressed position. In a case where it is determined that the pressed position is detected, the CPU 41 advances processing to step S44, and in a case where it is determined that the pressed position is not detected, in step S43, the CPU 41 determines as no string-pressing, that is, as an open string. Thereafter, the CPU 41 advances processing to step S44.

In step S44, the CPU 41 executes preceding trigger processing (described below in FIG. 11). In step S45, the CPU 41 records in the RAM 43 an output value of the string-pressing sensor 44 at preceding trigger timing. Here, the output value of the string-pressing sensor 44 at the preceding trigger timing is recorded in association with each pressed position as Snm. In such a case, n=a string number and m=a fret number are provided.

In step S46, the CPU 41 creates pitch correction data. Specifically, providing that pitch corresponding to a string number and a fret number is defined as standard pitch, when an output value of the string-pressing sensor 44 is Knm in a case where the sound is generated with the standard pitch, pitch correction data (Ph) is calculated by the following expression (1) using a correction value (CH).

$$Ph=(Knm-Snm)/100\times H \quad (1)$$

Here, since Snm varies depending on an actual string-pressing force, the pitch correction data varies depending on a string-pressing state.

After the processing of step S46 is finished, the CPU 41 finishes the string-pressing position detection processing.

Preceding Trigger Processing

Figure 10:
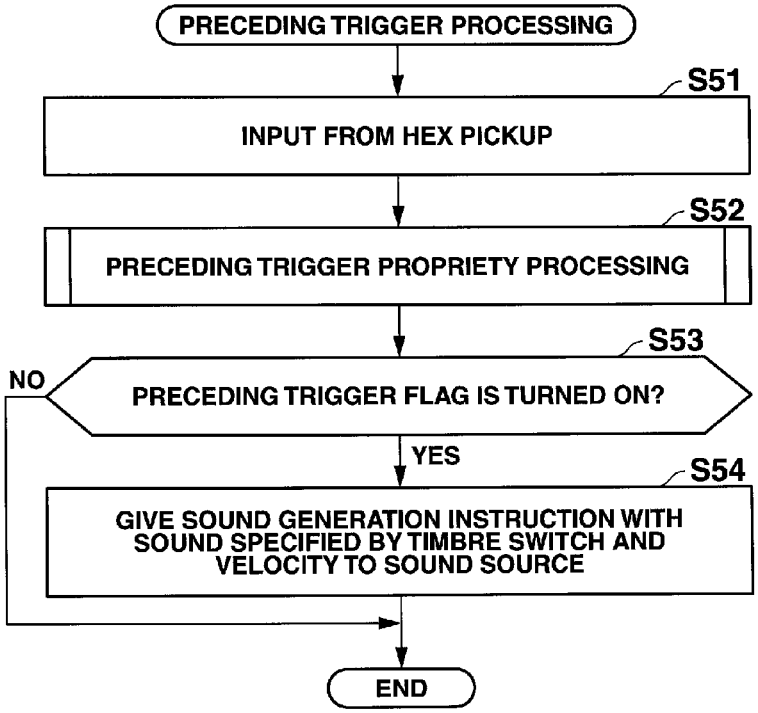
FIG. 10 is a flowchart showing preceding trigger processing executed in the electronic stringed instrument according to the present embodiment.

FIG. 10 is a flowchart showing preceding trigger processing (processing of step S44 in FIG. 9) executed in the electronic stringed instrument 1 according to the present embodiment. Here, preceding trigger is trigger to generate sound at timing at which string-pressing is detected prior to string picking by a performer.

Initially, in step S51, the CPU 41 receives output from the hex pickup 12 to acquire a vibration level of each string. In step S52, the CPU 41 executes preceding trigger propriety processing (described below in FIG. 11). In step S53, it is determined whether or not preceding trigger is feasible, that is, a preceding trigger flag is turned on. The preceding trigger flag is turned on in step S62 of preceding trigger propriety processing described below. In a case where the preceding trigger flag is turned on, the CPU 41 advances processing to step S54, and in a case where the preceding trigger flag is turned off, the CPU 41 finishes the preceding trigger processing.

In step S54, the CPU 41 sends a signal of a sound generation instruction to the sound source 45 based on timbre specified by a timbre switch and velocity decided in step S63 of preceding trigger propriety processing. After the processing of step S54 is finished, the CPU 41 finishes the preceding trigger processing.

Preceding Trigger Propriety Processing

Figure 11:
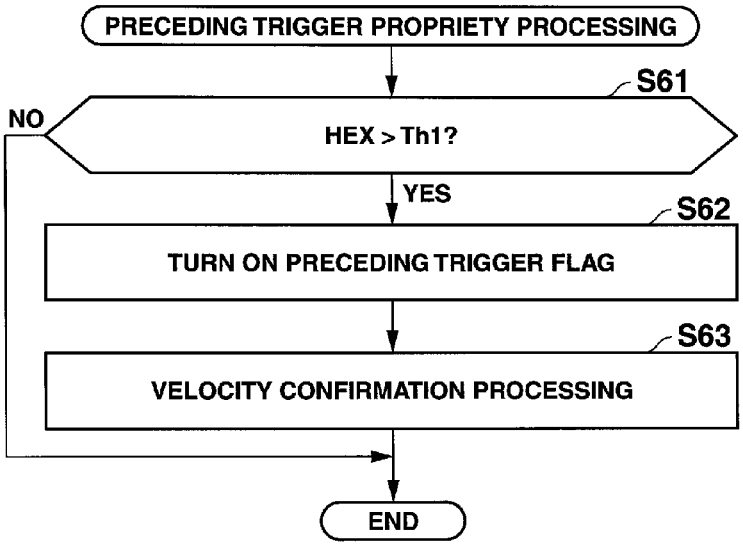
FIG. 11 is a flowchart showing preceding trigger propriety processing executed in the electronic stringed instrument according to the present embodiment.

FIG. 11 is a flowchart showing preceding trigger propriety processing (processing of step S52 in FIG. 10) executed in the electronic stringed instrument 1 according to the present embodiment.

Initially, in step S61, the CPU 41 determines whether or not a vibration level of each string based on the output from the hex pickup 12 received in step S51 in FIG. 10 is larger than a predetermined threshold (Th1). In a case where determination is YES in this step, the CPU 41 advances processing to step S62, and in a case of NO in this step, the CPU 41 finishes the preceding trigger propriety processing.

In step S62, the CPU 41 turns on the preceding trigger flag to allow preceding trigger. In step S63, the CPU 41 executes velocity confirmation processing.

Specifically, in the velocity confirmation processing, the following processing is executed. The CPU 41 detects acceleration of a change of a vibration level based on sampling data of three vibration levels prior to the point when a vibration level based on output of a hex pickup exceeds Th1 (referred to below as "Th1 point"). Specifically, first velocity of a change of a vibration level is calculated based on first and second preceding sampling data from the Th1 point. Further, second velocity of a change of a vibration level is calculated based on second and third preceding sampling data from the Th1 point. Then, acceleration of a change of a vibration level is detected based on the first velocity and the second velocity. Additionally, the CPU 41 applies interpolation so that velocity falls into a range from 0 to 127 in dynamics of acceleration obtained in an experiment.

Specifically, where velocity is "VEL", the detected acceleration is "K", dynamics of acceleration obtained in an experiment are "D" and a correction value is "H", velocity is calculated by the following expression (1).

$$VEL=(K/D)\times 128\times H \quad (2)$$

Data of a map (not shown in the drawing) indicating a relationship between the acceleration K and the correction value H is stored in the ROM 42 for every one of pitch of respective strings. In a case of observing a waveform of certain pitch of a certain string, there is a unique characteristic in a change of the waveform immediately after the string is distanced from a pick. Therefore, data of a map of the characteristic is stored in the ROM 42 beforehand for every one of pitch of respective strings so that the correction value H is acquired based on the detected acceleration K. After the processing of step S63 is finished, the CPU 41 finishes the preceding trigger propriety processing.

String Vibration Processing

Figure 12:
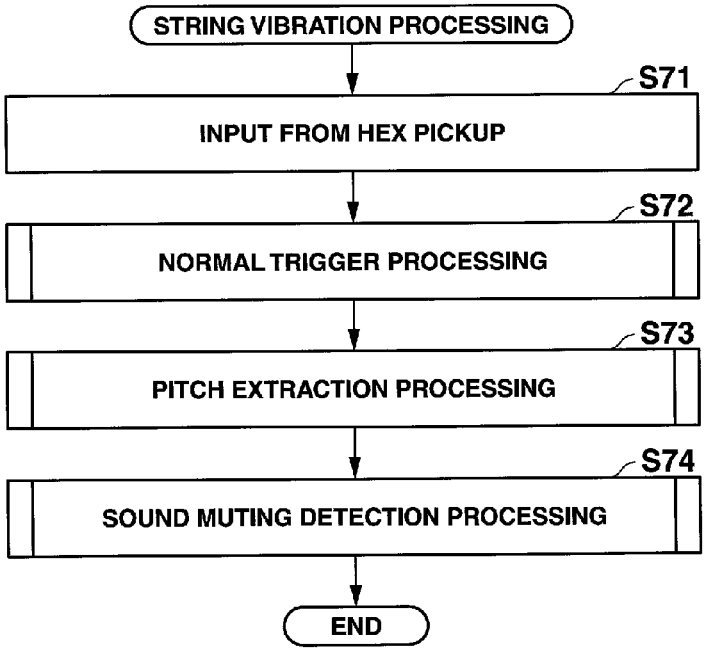
FIG. 12 is a flowchart showing string vibration processing executed in the electronic stringed instrument according to the present embodiment.

FIG. 12 is a flowchart showing string vibration processing (processing of step S32 in FIG. 8) executed in the electronic stringed instrument 1 according to the present embodiment.

Initially, in step S71, the CPU 41 receives output from the hex pickup 12 to acquire a vibration level of each string. In step S72, the CPU 41 executes normal trigger processing (described below in FIG. 13). In step S73, the CPU 41 executes pitch extraction processing (described below in FIG. 14). In step S74, the CPU 41 executes sound muting detection processing (described below in FIG. 15). After the processing of step S74 is finished, the CPU 41 finishes the string vibration processing.

Normal Trigger Processing

Figure 13:
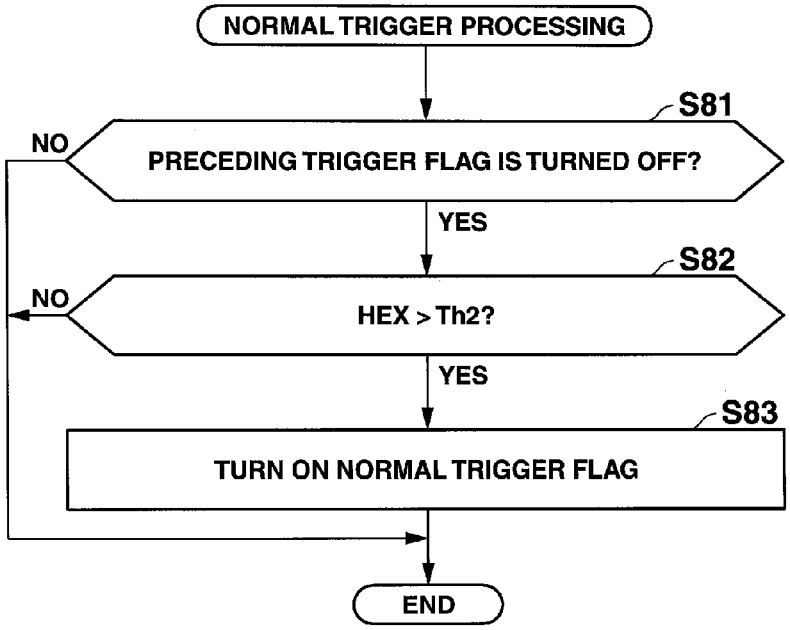
FIG. 13 is a flowchart showing normal trigger processing executed in the electronic stringed instrument according to the present embodiment.

FIG. 13 is a flowchart showing normal trigger processing (processing of step S72 in FIG. 12) executed in the electronic stringed instrument 1 according to the present embodiment. Normal trigger is trigger to generate sound at timing at which string picking by a performer is detected.

Initially, in step S81, the CPU 41 determines whether preceding trigger is not allowed. That is, the CPU 41 determines whether or not a preceding trigger flag is turned off. In a case where it is determined that preceding trigger is not allowed, the CPU 41 advances processing to step S82. In a case where it is determined that preceding trigger is allowed, the CPU 41 finishes the normal trigger processing. In step S82, the CPU 41 determines whether or not a vibration level of each string based on output from the hex pickup 12 that is received in step S71 in FIG. 12 is larger than a predetermined threshold (Th1). In a case where determination is YES in this step, the CPU 41 advances processing to step S83, and in a case of NO in this step, the CPU 41 finishes the normal trigger processing. In step S83, the CPU 41 turns on a normal trigger flag so as to allow normal trigger. After the processing of step S83 is finished, the CPU 41 finishes the normal trigger processing.

Pitch Extraction Processing

Figure 14:
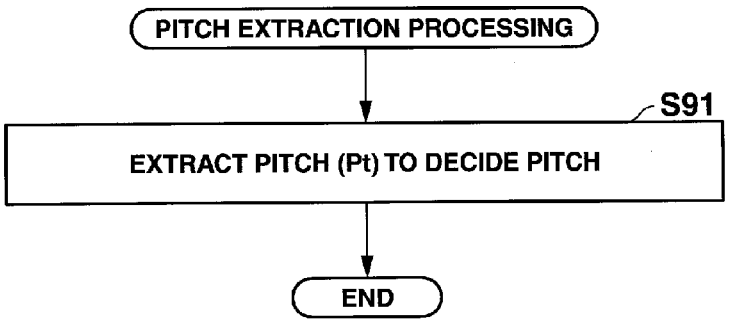
FIG. 14 is a flowchart showing pitch extraction processing executed in the electronic stringed instrument according to the present embodiment.

FIG. 14 is a flowchart showing pitch extraction processing (processing of step S73 in FIG. 12) executed in the electronic stringed instrument 1 according to the present embodiment.

In step S91, the CPU 41 extracts pitch by means of known art to decide pitch. Here, the known art includes, for example, a technique described in Japanese Unexamined Patent Application Publication No. H1-177082.

Sound Muting Detection Processing

Figure 15:
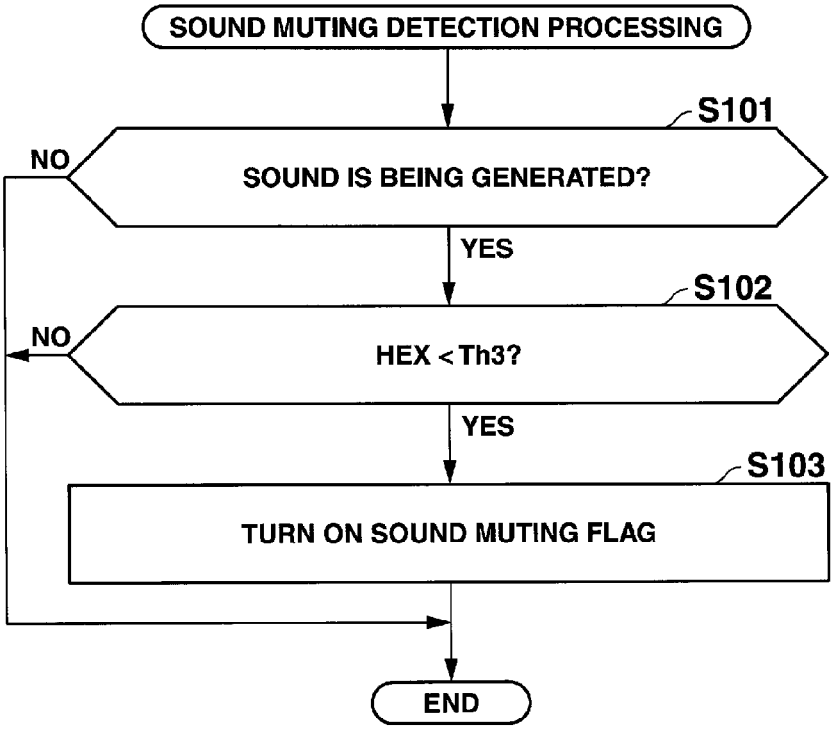
FIG. 15 is a flowchart showing sound muting detection processing executed in the electronic stringed instrument according to the present embodiment.

FIG. 15 is a flowchart showing sound muting detection processing (processing of step S74 in FIG. 12) executed in the electronic stringed instrument 1 according to the present embodiment.

Initially, in step S101, the CPU 41 determines whether or not the sound is being generated. In a case where determination is YES in this step, the CPU 41 advances processing to step S102, and in a case where determination is NO in this step, the CPU 41 finishes the sound muting detection processing. In step S102, the CPU 41 determines whether or not a vibration level of each string based on output from the hex pickup 12 that is received in step S71 in FIG. 12 is smaller than a predetermined threshold (Th3). In a case where determination is YES in this step, the CPU 41 advances processing to step S103, and in a case of NO in this step, the CPU 41 finishes the sound muting detection processing. In step S103, the CPU 41 turns on a sound muting flag. After the processing of step S103 is finished, the CPU 41 finishes the sound muting detection processing.

Integration Processing

Figure 16:
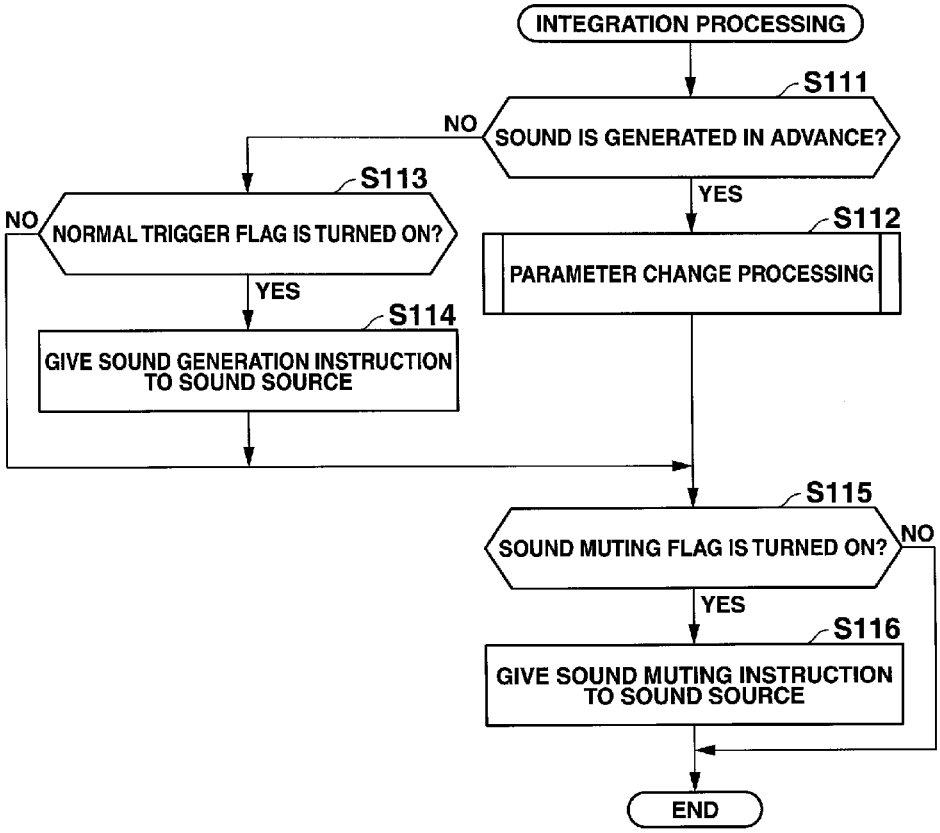
FIG. 16 is a flowchart showing integration processing executed in the electronic stringed instrument according to the present embodiment.

FIG. 16 is a flowchart showing integration processing (processing of step S33 in FIG. 8) executed in the electronic stringed instrument 1 according to the present embodiment. In the integration processing, the result of the string-pressing position detection processing (processing of step S31 in FIG. 8) and the result of the string vibration processing (processing of step S32 in FIG. 8) are integrated.

Initially, in step S111, the CPU 41 determines whether or not sound is generated in advance. That is, in the preceding trigger processing (refer to FIG. 10), it is determined whether or not a sound generation instruction is given to the sound source 45. In a case where the sound generation instruction is given to the sound source 45 in the preceding trigger processing, the CPU 41 advances processing to step S112. In step S112, the CPU 41 executes parameter change processing (described below in FIG. 17), and advances processing to step S115.

On the other hand, in step S111, in a case where it is determined that the sound generation instruction is not given to the sound source 45 in the preceding trigger processing, the CPU 41 advances processing to step S113. In step S113, the CPU 41 determines whether or not a normal trigger flag is turned on. In a case where the normal trigger flag is turned on, the CPU 41 sends a sound generation instruction signal to the sound source 45 in step S114, and advances processing to step S115. In a case where the normal trigger flag is turned off in step S113, the CPU 41 advances processing to step S115.

In step S115, the CPU 41 determines whether or not a sound muting flag is turned on. In a case where the sound muting flag is turned on, the CPU 41 sends a sound muting instruction signal to the sound source 45 in step S116. In a case where the sound muting flag is turned off, the CPU 41 finishes the integration processing. After the processing of step S116 is finished, the CPU 41 finishes the integration processing.

Parameter Change Processing

Figure 17:
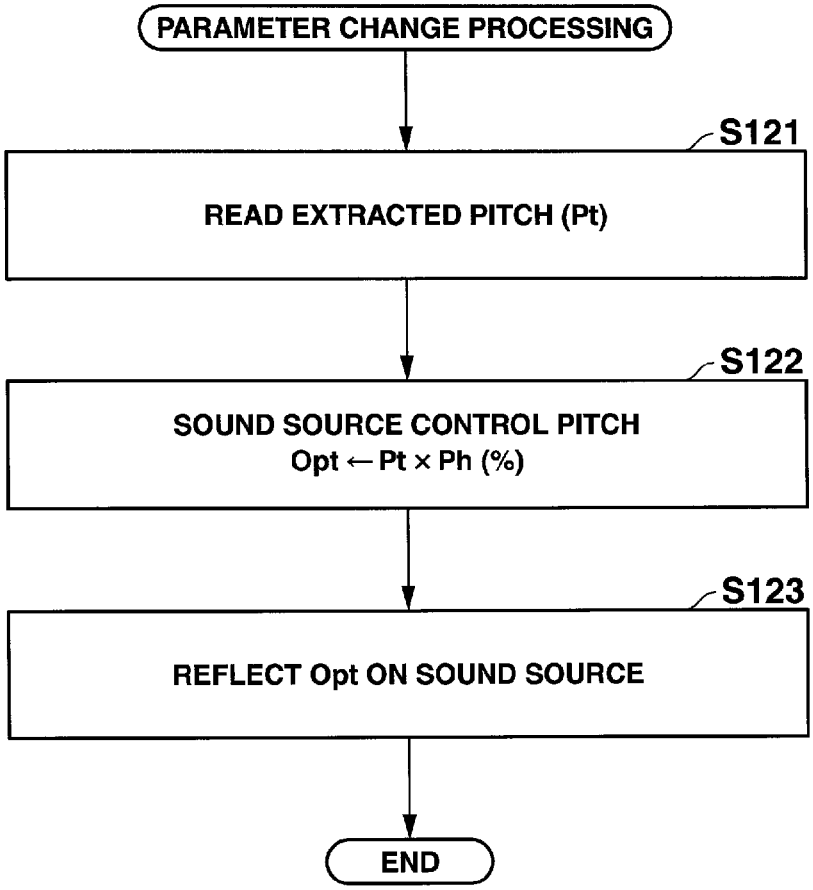
FIG. 17 is a flowchart showing parameter change processing executed in the electronic stringed instrument according to the present embodiment.

FIG. 17 is a flowchart showing parameter change processing (processing of step S112 in FIG. 16) executed in the electronic stringed instrument 1 according to the present embodiment.

Initially, in step S121, the CPU 41 reads pitch (Pt) extracted in step S91 of FIG. 14. In step S122, the CPU 41 multiplies the read pitch (Pt) by the pitch correction data (Ph) calculated in step S46 of FIG. 9, thereby calculating sound source control pitch (Opt) for controlling the sound source 45. In step S123, the CPU 41 sends the calculated sound source control pitch to the sound source 45 so as to reflect the sound source control pitch (Opt) on the sound source 45. Therefore, it is possible to correct pitch depending on a string-pressing state.

String-pressing position Detection Processing (First Variation)

Figure 18:
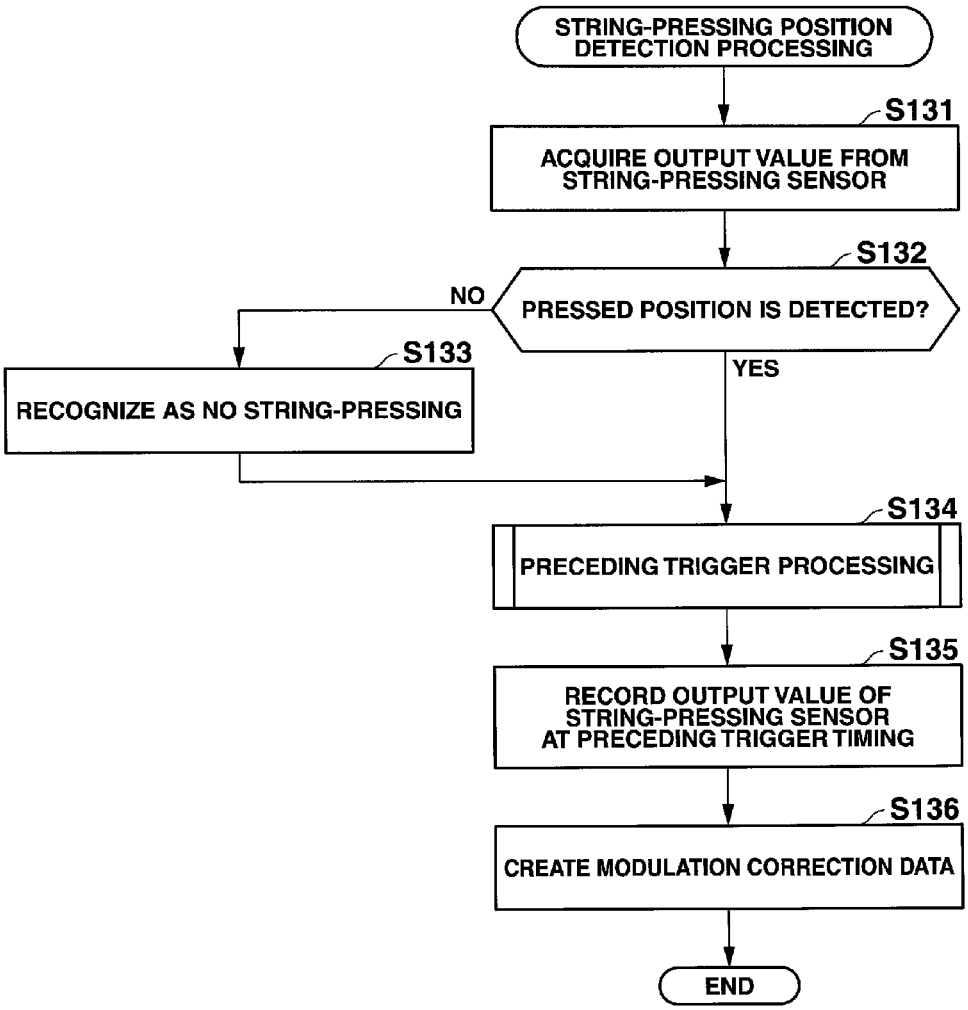
FIG. 18 is a flowchart showing a first variation of the string-pressing position detection processing executed in the electronic stringed instrument according to the present embodiment.

FIG. 18 is a flowchart showing a first variation of the string-pressing position detection processing (processing of step S31 in FIG. 8) executed in the electronic stringed instrument 1 according to the present embodiment.

Processing from steps S131 up to S135 are the same as the processing of steps S41 up to S45 in FIG. 9 described above.

In step S136, the CPU 41 creates modulation correction data. Specifically, providing that pitch corresponding to a string number and a fret number is defined as standard pitch, when an output value of the string-pressing sensor 44 is Knm in a case where the sound is generated with the standard pitch, modulation correction data (Mh) is calculated by the following expression (3) using a correction value (I).

$$Mh=(Knm-Snm)/100\times I \quad (3)$$

After the processing of step S136 is finished, the CPU 41 finishes the string-pressing position detection processing.

Such modulation includes vibrato by means of an LFO (Low Frequency Oscillator), and the like.

Parameter Change Processing (First Variation)

Figure 19:
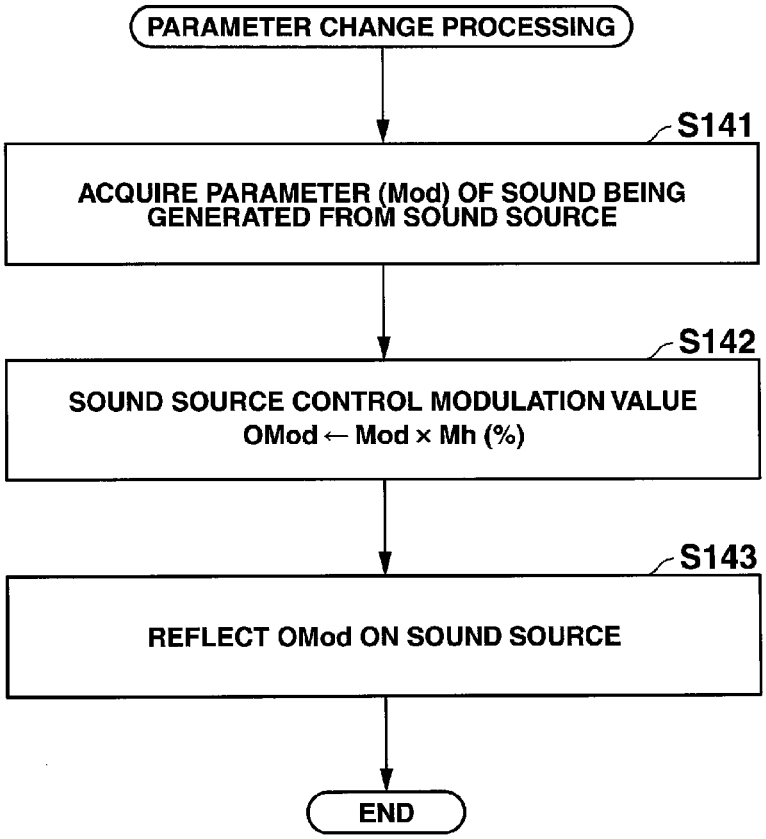
FIG. 19 is a flowchart showing a first variation of the parameter change processing executed in the electronic stringed instrument according to the present embodiment.

FIG. 19 is a flowchart showing a first variation of the parameter change processing (processing of step S112 in FIG. 16) executed in the electronic stringed instrument 1 according to the present embodiment.

Initially, in step S141, the CPU 41 acquires a parameter (Mod) concerning a musical sound being generated from the sound source 45. Such parameter includes timbre, pitch, volume, a period of vibrato and the like. In step S142, the CPU 41 multiplies the acquired parameter (Mod) by the modulation correction data (Mh) calculated in step S136 of FIG. 18, thereby calculating a sound source modulation value (OMod) for controlling the sound source 45. In step S143, the CPU 41 sends the calculated sound source modulation value to the sound source 45 so as to reflect the sound source modulation value (OMod) on the sound source 45. String-pressing position Detection Processing (Second Variation)

Figure 20:
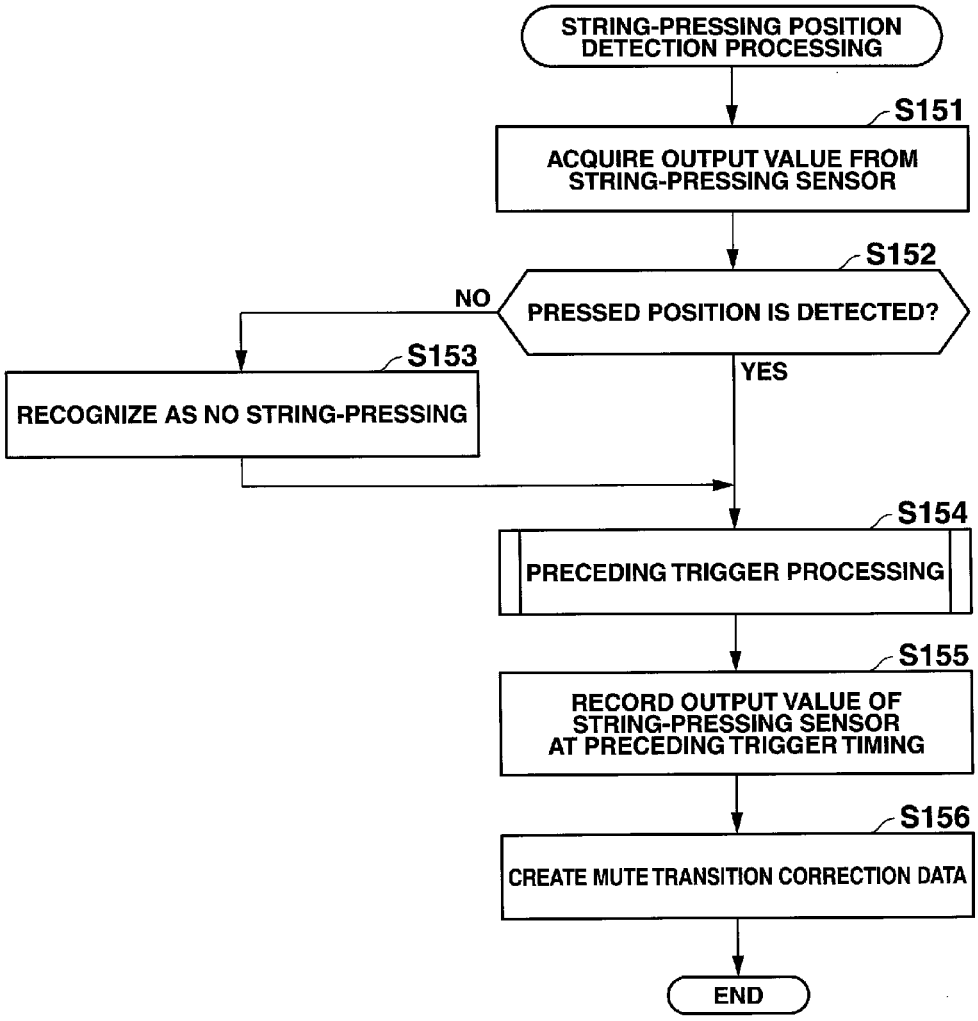
FIG. 20 is a flowchart showing a second variation of the string-pressing position detection processing executed in the electronic stringed instrument according to the present embodiment.

FIG. 20 is a flowchart showing a second variation of the string-pressing position detection processing (processing of step S31 in FIG. 8) executed in the electronic stringed instrument 1 according to the present embodiment.

Processing of steps S151 up to S155 is the same as the processing of steps S41 up to S45 in FIG. 9 described above.

In step S156, the CPU 41 creates mute transition correction data. Specifically, providing that pitch corresponding to a string number and a fret number is defined as standard pitch, when an output value of the string-pressing sensor 44 is Knm in a case where the sound is generated with the standard pitch, mute transition correction data (Mu) is calculated by the following expression (4) using a correction value (J).

$$Mu=(Knm-Snm)/100\times J \quad (4)$$

After the processing of step S156 is finished, the CPU 41 finishes the string-pressing position detection processing.

Parameter Change Processing (Second Variation)

Figure 21:
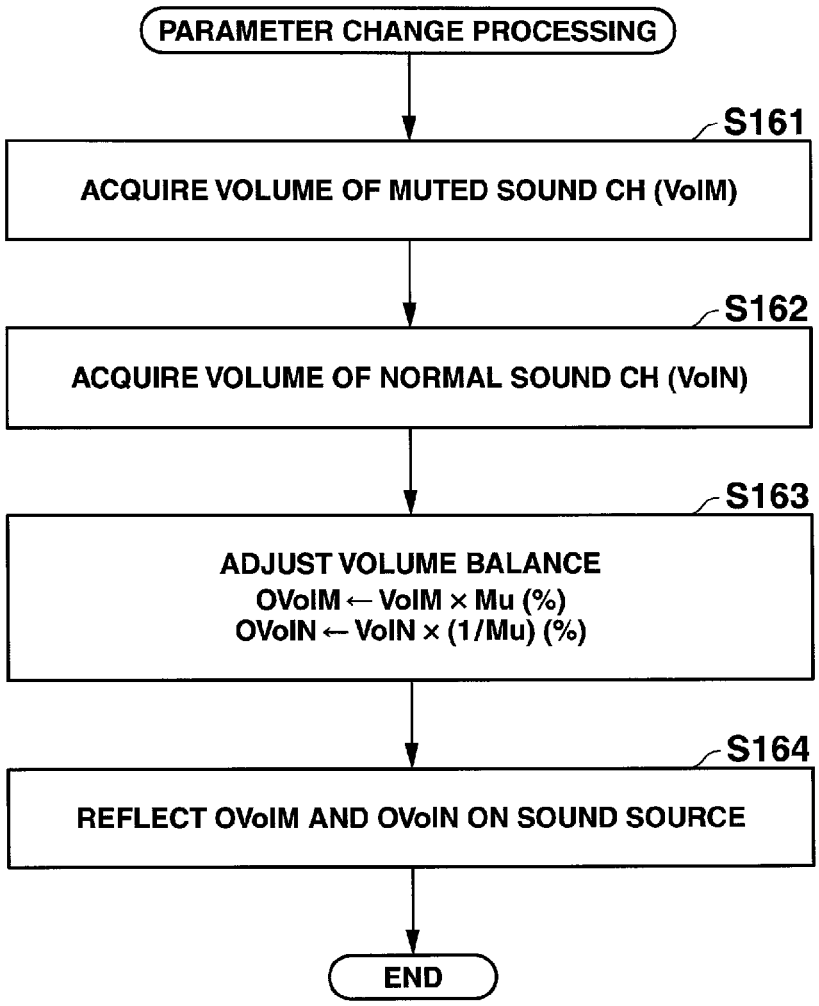
FIG. 21 is a flowchart showing a second variation of the parameter change processing executed in the electronic stringed instrument according to the present embodiment.

FIG. 21 is a flowchart showing a second variation of the parameter change processing (processing of step S112 in FIG. 16) executed in the electronic stringed instrument 1 according to the present embodiment.

As a premise, in the present embodiment, a channel setting is made so as to generate both a normal sound and a muted sound for one musical sound in the sound source 45.

Initially, in step S161, the CPU 41 acquires volume of a muted sound channel (VolM) from the sound source 45. In step S162, the CPU 41 acquires volume of a normal sound channel (VolN) from the sound source 45. In step S163, the CPU 41 adjusts a volume balance. Specifically, the CPU 41 multiplies the acquired volume of the muted sound channel (VolM) by the mute transition correction data (Mu) calculated in step S156 of FIG. 20, thereby calculating a volume balance adjusted value (OVolM) of the muted sound. Further, the CPU 41 multiplies the acquired volume of the normal sound channel (VolN) by the reciprocal (1/Mu) of the mute transition correction data (Mu) calculated in step S156 of FIG. 20, thereby calculating a volume balance adjusted value of the normal sound (OVolN). In step S164, the CPU 41 sends the calculated respective volume balance adjusted value to the sound source 45 so that the volume balance adjusted value of the muted sound (OVolM) and the volume balance adjusted value of the normal sound (OVolN) are reflected on the sound source 45.

A description has been given above concerning the configuration and processing of the electronic stringed instrument 1 of the present embodiment.

In the present embodiment, the CPU 41 detects an operation performed with respect to a plurality of the frets 23 provided on the fingerboard 21, decides pitch of a musical sound to be generated based on the detected operation, decides sound generation timing for the musical sound to be generated, instructs a connected sound source to generate a musical sound of the decided pitch at the decided sound generation timing, and controls the musical sound generated in the connected sound source 45 based on a state of the detected operation.

Therefore, it is possible to reflect a subtle change in timbre or pitch according to a string-pressing state.

Further, in the present embodiment, the CPU 41 detects, as a state of an operation, a proximity state between a finger used for the operation and the fret 23.

Therefore, it is possible to reflect a subtle change in timbre or pitch according to a proximity state between a finger used for an operation and a fret.

Further, in the present embodiment, the CPU 41 has an electrostatic sensor provided within the fingerboard 21 corresponding to each position of the plurality of the frets 23.

Therefore, it is possible to reflect a subtle change in timbre or pitch according to output of the electrostatic sensor.

Further, in the present embodiment, the CPU 41 has a plurality of strings 22, and decides, as sound generation timing, timing at which any of the strings 22 is picked.

Therefore, it is possible to realistically reproduce sound generation timing of a stringed instrument.

Further, in the present embodiment, the CPU 41 changes pitch of a musical sound generated in the connected sound source 45 based on the state of the detected operation.

Therefore, it is possible to reflect a subtle change in pitch according to a string-pressing state.

Further, in the present embodiment, the connected sound source 45 has a modulation unit configured to modulate a parameter of a musical sound instructed to be generated, and the CPU 41 changes a modulation degree of the modulation unit based on the state of the detected operation.

Therefore, it is possible to reflect a subtle change in a modulation degree according to a string-pressing state.

Further, in the present embodiment, the connected sound source 45 is configured to generate the sound by mixing different types of musical sounds in response to an instruction of sound generation, and the CPU 41 changes a mixing ratio of the different types of musical sounds based on the state of the detected operation.

Therefore, it is possible to change a mixing ratio of different types of musical sounds so as to reflect a subtle timbre change from a normal sound to a muted sound.

A description has been given above concerning embodiments of the present invention, but these embodiments are merely examples and are not intended to limit the technical scope of the present invention. The present invention can have various other embodiments, and in addition various types of modification such as abbreviations or substitutions can be made within a range that does not depart from the scope of the invention. These embodiments or modifications are included in the range and scope of the invention described in the present specification and the like, and are included in the invention and an equivalent range thereof described in the scope of the claims.

What is claimed is:

1. An electronic stringed instrument, comprising:

an operation detector configured to detect an operation performed with respect to a plurality of frets provided on a fingerboard;

a pitch decision unit configured to decide a pitch of a musical sound to be generated based on the operation detected by the operation detector;

a sound generation timing decision unit configured to decide a sound generation timing for the musical sound to be generated;

a sound generation instruction unit configured to instruct a sound source to generate the musical sound of the pitch decided by the pitch decision unit at the sound generation timing decided by the sound generation timing decision unit, wherein the musical sound is generated by mixing different types of musical sounds; and a controller configured to control the musical sound generated in the sound source based on a state of the operation detected by the operation detector, wherein the controller changes a mixing ratio of the different types of musical sounds based on the state of the operation detected by the operation detector.

2. The electronic stringed instrument according to claim 1, wherein the operation detector detects an operated fret among the plurality of the frets, while detecting the state of the operation performed for the operated fret.

3. The electronic stringed instrument according to claim 1, wherein the operation detector detects, as the state of the operation, a proximity state between a finger used for the operation and an operated fret among the plurality of the frets.

4. The electronic stringed instrument according to claim 1, wherein the operation detector comprises an electrostatic sensor provided within the fingerboard corresponding to each position of the plurality of the frets.

5. The electronic stringed instrument according to claim 1, wherein the sound generation timing decision unit comprises a plurality of strings, and decides, as the sound generation timing, a timing at which any of the strings is picked.

6. The electronic stringed instrument according to claim 5, further comprising:

a pitch extractor configured to extract a vibration pitch of the picked string, wherein the controller controls the pitch of the musical sound generated in the sound source based on the pitch extracted by the pitch extraction unit.

7. The electronic stringed instrument according to claim 1, wherein the controller changes the pitch of the musical sound generated in the sound source based on the state of the operation detected by the operation detector.

8. The electronic stringed instrument according to claim 1, wherein:

the sound source has a modulator configured to modulate a parameter of the musical sound instructed to be generated, and the controller changes a modulation degree of the modulator based on the state of the operation detected by the operation detector.

9. A musical sound generation method used for an electronic stringed instrument, comprising:

detecting an operation performed with respect to a plurality of frets provided on a fingerboard;

deciding a pitch of a musical sound to be generated based on the detected operation;

deciding a sound generation timing for the musical sound to be generated;

instructing a sound source to generate the musical sound of the decided pitch at the decided sound generation timing, wherein the musical sound is generated by mixing different types of musical sounds; and controlling the musical sound generated in the sound source based on a state of the detected operation, wherein the controlling comprises changing a mixing ratio of the different types of musical sounds based on the state of the detected operation.

10. The musical sound generation method according to claim 9, wherein an operated fret among the plurality of the frets is detected, while the state of the operation performed for the operated fret is detected.

11. The musical sound generation method according to claim 9, wherein as the state of the operation, a proximity state between a finger used for the operation and an operated fret among the plurality of frets is detected.

12. The musical sound generation method according to claim 9, wherein a timing at which any of a plurality of strings of the electronic stringed instrument is picked is decided as the sound generation timing.

13. The musical sound generation method according to claim 12, further comprising:

extracting the vibration pitch of the picked string; and controlling the pitch of the musical sound generated in the sound source based on the extracted pitch.

14. The musical sound generation method according to claim 9, wherein the pitch of the musical sound generated in the sound source is changed based on the state of the detected operation.

15. A non-transitory storage medium capable of reading by a computer used as an electronic stringed instrument, and storing a program configured to cause the computer to execute functions comprising:

detecting an operation performed with respect to a plurality of frets provided on a fingerboard;

deciding a pitch of a musical sound to be generated based on the detected operation;

deciding a sound generation timing for the musical sound to be generated;

instructing a sound source to generate a musical sound of the decided pitch at the decided sound generation timing, wherein the musical sound is generated by mixing different types of musical sounds; and controlling the musical sound generated in the sound source based on a state of the detected operation, wherein the controlling comprises changing a mixing ratio of the different types of musical sounds based on the state of the detected operation.

16. The non-transitory storage medium according to claim 15, wherein an operated fret among the plurality of the frets is detected, while the state of the operation performed for the operated fret is detected.

17. The non-transitory storage medium according to claim 15, wherein, as the state of the operation, a proximity state between a finger used for the operation and an operated fret among the plurality of frets is detected.

18. The non-transitory storage medium according to claim 15, wherein a timing at which any of a plurality of strings of the electronic stringed instrument is picked is decided as the sound generation timing.

19. The non-transitory storage medium according to claim 15, wherein the pitch of the musical sound generated in the sound source is changed based on the state of the detected operation.

* * * * *